United States Patent [19]

Lanigan

[11] Patent Number: 4,756,137

[45] Date of Patent: Jul. 12, 1988

[54] CAPPING MACHINE

[75] Inventor: Donald E. Lanigan, Greenlawn, N.Y.

[73] Assignee: National Instrument Company, Inc., Baltimore, Md.

[21] Appl. No.: 22,999

[22] Filed: Mar. 6, 1987

[51] Int. Cl.[4] ..... B67B 3/20; B65B 7/28

[52] U.S. Cl. ..... 53/202; 53/306; 53/317; 53/331.5

[58] Field of Search ..... 53/306, 307, 317, 331.5, 53/202

[56] References Cited

U.S. PATENT DOCUMENTS

| | | | |
|---|---|---|---|
| 3,212,231 | 10/1965 | Pechmann | 53/317 X |
| 3,392,505 | 7/1968 | Luther | 53/307 |
| 3,415,034 | 12/1968 | Schmidt | 53/307 X |
| 3,805,488 | 4/1974 | Holstein | 53/331.5 X |
| 4,528,796 | 7/1985 | Lemaire | 53/307 X |
| 4,535,583 | 8/1985 | Tanaka et al. | 53/317 X |
| 4,616,466 | 10/1986 | Tanaka et al. | 53/317 X |

*Primary Examiner*—Horace M. Culver
*Attorney, Agent, or Firm*—Paul M. Craig, Jr.

[57] ABSTRACT

A capping machine in which open containers are successively brought to a capping station where a respective container is held against rotation to permit closing of the open container by rotating movement of a cap fed from a reservoir to a pick-up station; a head frame assembly of the machine includes a spindle assembly carrying a chuck at the lower spindle end and drivingly connected by way of an adjustable clutch and by way of a positive drive connection with a driving motor; additionally, the spindle assembly includes a double-acting pneumatic cylinder to cause reciprocation of the spindle in its axial direction; the various components of the head frame assembly are balanced about a pivot shaft on which they are mounted for pivot movement in unison so that the actuating force for pivoting the head frame assembly can be kept relatively small; in operation, the head frame assembly is pivoted from a capping position where the chuck is in alignment with the open end of the container, into a pick-up position where a plunger transfers the end cap in the chute to the chuck while the chuck and spindle asembly are in a retracted position. The head frame assembly is thereupon pivoted back into the capping position and the cap is secured onto the open neck of the container as the chuck is displaced by the pneumatic cylinder into the extended position.

20 Claims, 5 Drawing Sheets

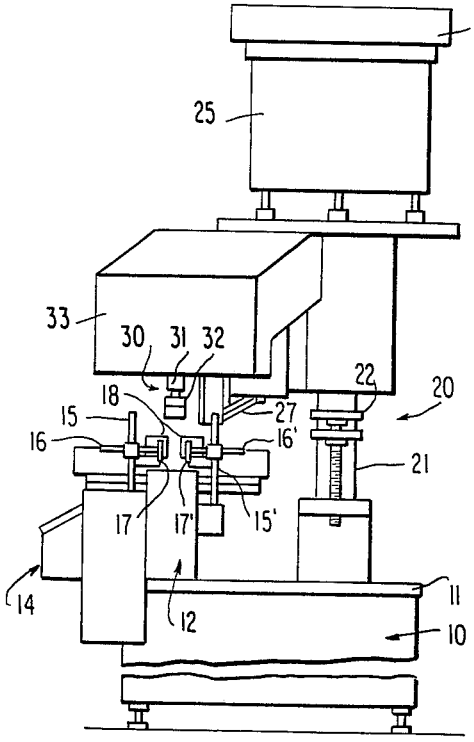
FIG.3
FIG.7
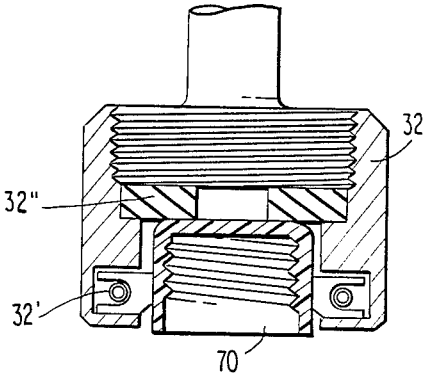
FIG.4
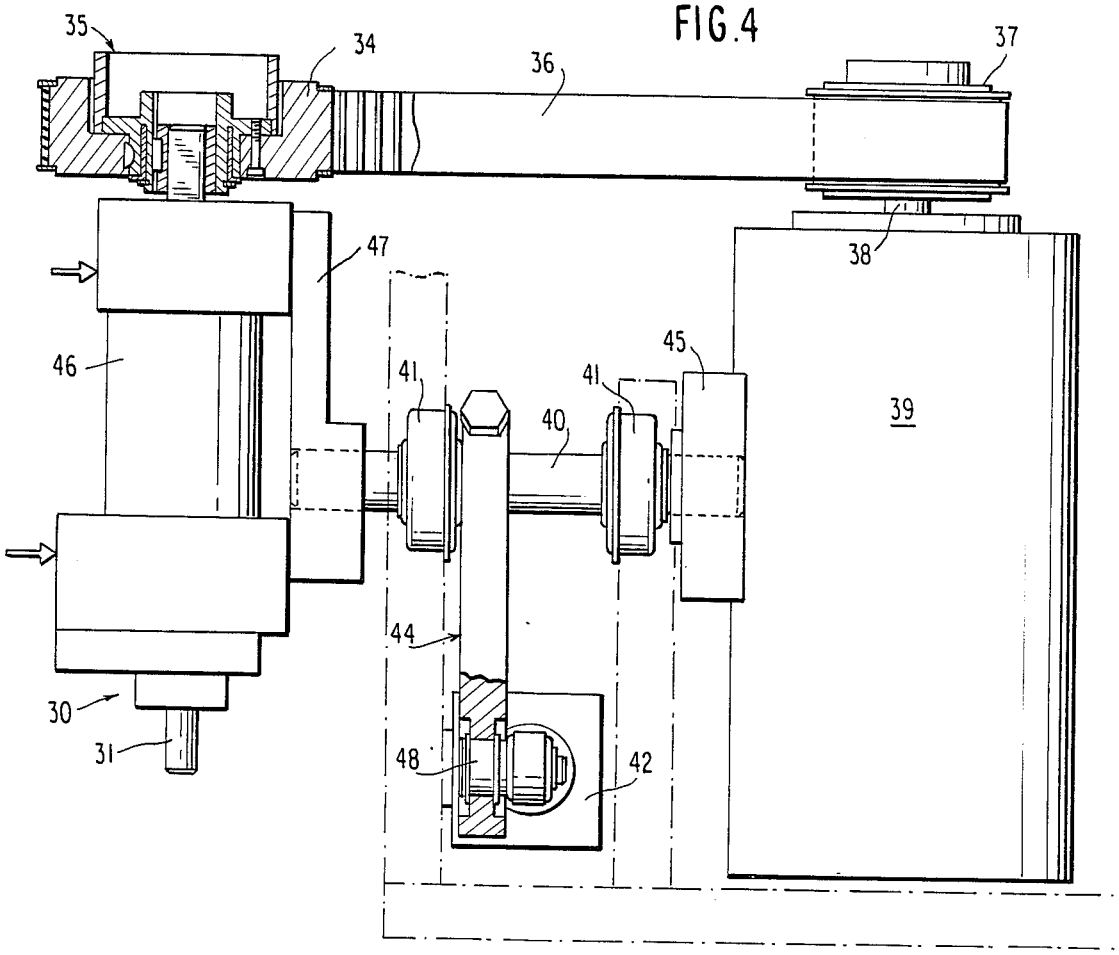

CAPPING MACHINE

FIELD OF INVENTION

The present invention relates to a capping machine for capping, for example, open necks of bottles, in which the caps are fed from a reservoir by way of a chute to a pick-up station where the cap at the end of the chute is transferred over the open bottle neck of the container which is held against rotation in the capping station and in which the cap is fastened onto the bottle neck by rotary movement.

BACKGROUND OF THE INVENTION

The prior art capping machines which are commercially available, utilize for the most part a lever arm which pulls the cap from the chute end into the area between the chuck and the top of the container which is being capped. This, in turn, requires a clearance between the container tops and the chuck to allow for the thickness of the lever arm plus the height of the cap that the lever arm has picked out of the chute. This clearance distance is normally fixed on the prior art machines and is selected such as to allow room for the maximum cap height that the machine is designed to handle. Additionally, the chuck in the prior art devices is required to make two downward and upward strokes during each capping cycle because the chuck must come down once over the lever arm to pick up the cap, then retract to allow the lever arm to move back to its position behind the cap chute and thereafter must make another downward and upward movement as the cap is actually being applied onto the container. This means that at a capping rate of, for example, fifty caps per minute, the prior art capping machines must perform one hundred reciprocating strokes per minute which thus limits the capping rate. Though the clearance between the chuck and the top of the containers varies from machine to machine, it is generally of the order of two inches or more. However, the length of the stroke of the chuck determines the length of time required to complete the stroke and therewith the cycle rate. Additionally, the prior art capping machines also utilize frequently a pivot chute which is raised to allow the cap pick-up lever arm to pass underneath the chute end after the cap has been placed into the chuck.

A different approach has been suggested in the U.S. Pat. No. 3,212,231 in which the spindle carrying the capping head is adapted to be pivoted from a position over the bottle necks into an inclined position in which a plunger or ram transfers the cap in the chute end onto the chuck. In addition to the pivotal motion of the spindle together with the chuck, the chuck also undergo vertical movement together with the spindle to bring a respective cap into engagement with the bottle neck. These pivot and vertical movements are accomplished in this patent by two separate mechanical systems, which are cam-operated through a number of levers and linkages. The large number of the mechanical components involved results in relatively large moving masses which is not only relatively expensive to manufacture but also imposes physical limitations on the cycle rate at which the machine can operate. Furthermore, the spindle drive in this patent is essentially a friction drive utilizing friction wheels frictionally driving the spindle when the latter are in the vertical position. Such friction drive is subject to wear, a factor further enhanced by the continuous engagement and disengagement, and additionally requires a delicate adjustment and alignment of the parts to maintain a balanced, uniform driving action to the spindles. As there is slippage in any friction drive, the actual application of torque of the cap is, in all likelihood, a combination of the torque supplied to the spindle by way of the friction drive and the ball detent clutch as disclosed in the patent.

SUMMARY OF THE INVENTION

It is the principal object of the present invention to provide a capping machine which avoids the aforementioned shortcomings and drawbacks encountered in the prior art devices by extremely simple and operationally reliable means. In addition to a simple construction requiring relatively little space, it is an object of the present invention to provide a capping machine which can be operated reliably at relatively high rates, requires relatively small actuating forces, does away with the lever arms of the prior art commercial machines, and can be readily expanded into multi-spindle machines permitting the simultaneous capping of several containers arranged within a case.

The underlying problems are solved according to the present invention in that the spindle together with the pick-up chuck for a cap is adapted to be pivoted about a pivot axis from a capping position in alignment with the open bottle neck into a pick-up position in which the cap at the end of the chute is picked-up by the chuck, whereupon the spindle and chuck together with the cap retained by the chuck are returned to the capping position where the cap is fastened onto the bottle neck by rotary movement after the chuck is moved a small distance toward the open container end in the axial direction of the spindle. According to an important feature of the present invention, the drive unit, for example, an electric motor is mounted for pivotal movement in unison with the spindle and chuck assembly so that the motor remains in continuous positive drive connection with the spindle. According to another feature of the present invention, the spindle and chuck assembly as well as the driving motor are so arranged in the head frame assembly about the pivot axis as to substantially balance the mass of these pivoting parts about this pivot axis, thereby permitting the use of relatively small actuating forces for the pivoting movements. Furthermore, the capper mechanism of this invention, properly speaking, can be encased in a housing that would enclose a volume of only about one cubic foot which permits the realization of a compact and versatile module that can be adapted to many applications, such as multi-spindle machines. Furthermore, the actual movement of the spindle about its own axis, as the chuck is caused to approach the bottle neck during the fastening operation, is obtained by a built-in pneumatic actuator in the form of an air cylinder which eliminates the need for vertical oscillation of the entire head assembly for each cycle.

The present invention permits the elimination of cams, camshafts, levers, linkages for large reciprocating masses as present in the aforementioned U.S. patent. Additionally, by the use of a positive drive connection, for example, utilizing a positive belt drive as contrasted to a friction wheel drive, the clutch adjustment in the manually adjustable clutch transmitting the torque from the positive drive connection onto the spindle which can be manually carried out, assures that this clutch adjustment is the only parameter determining the application of torque to the spindle.

As the cap is placed into the chuck in an offset position, the chuck only has to make one downward and upward stroke during each cycle so that the cycle rate can be doubled compared to the commercially available machines utilizing a lever arm. Furthermore, as no clearance is required for the pick-up lever arm as practiced in the prior art machines, the stroke length of the chuck can be reduced, resulting in saving of time and increase in the cycle rate.

DESCRIPTION OF THE DRAWING

These and other objects, features and advantages of the present invention will become more apparent from the following description when taken in connection with the accompanying drawing which shows, for purposes of illustration only, two embodiments in accordance with the present invention, and wherein:

FIG. 3 is a side elevational view of the capping machine of FIG. 1;

FIG. 4 is a front elevational view of the head frame assembly in accordance with the present invention;

FIG. 7 is a cross-sectional view through a chuck showing a cap held in position therein;

DETAILED DESCRIPTION OF THE INVENTION

Figure 1:
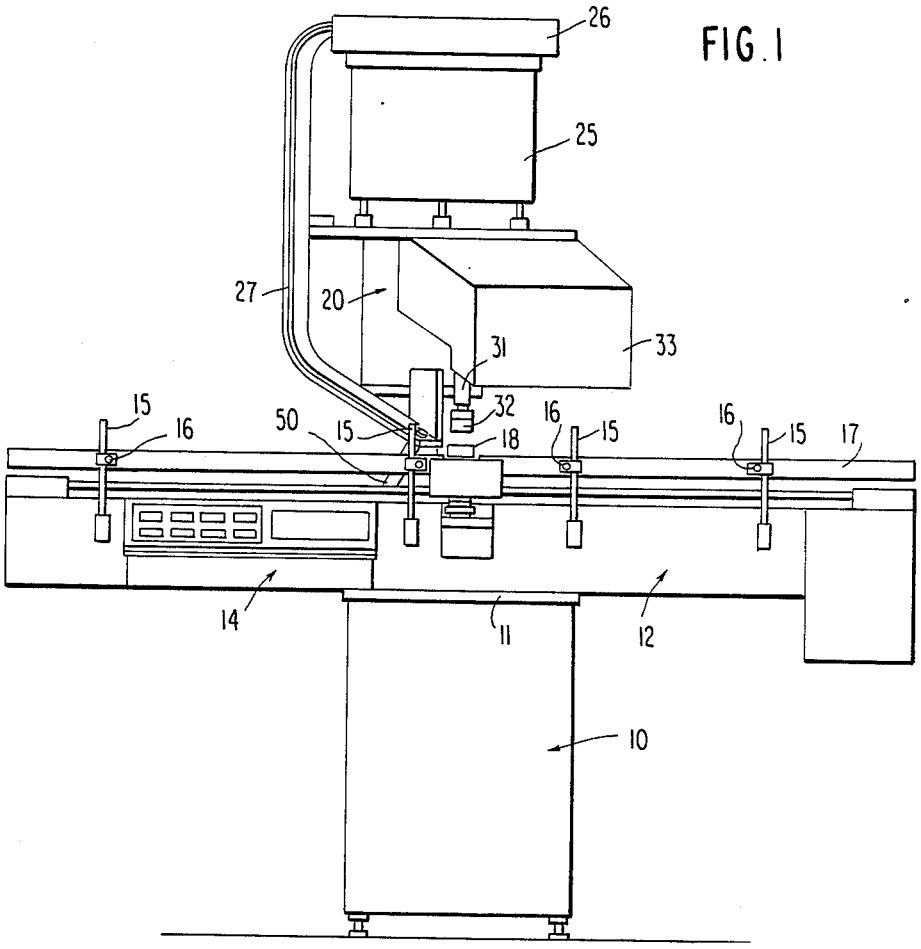
FIG. 1 is a somewhat schematic front elevational view of a capping machine in accordance with the present invention.
Figure 2:
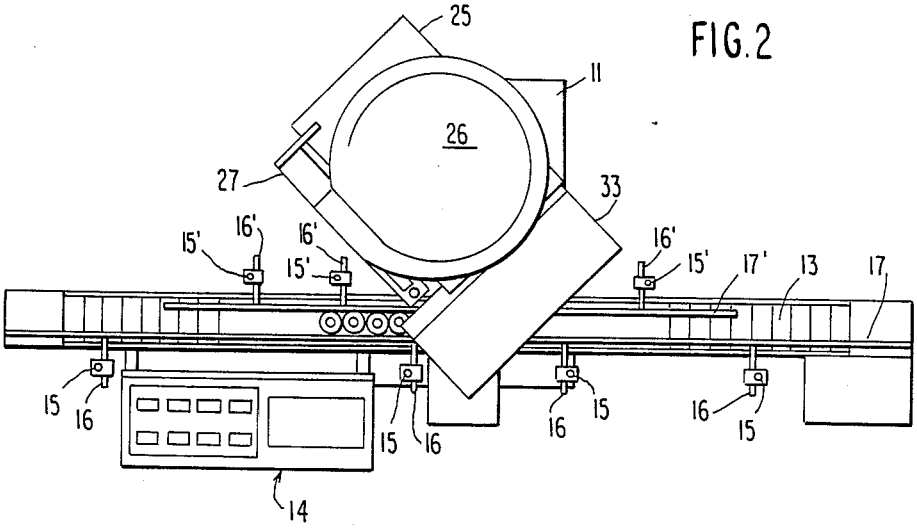
FIG. 2 is a top plan view on the machine of FIG. 1.

Referring now to the drawing wherein like reference numerals are used throughout the various views to designate like parts, and more particularly to FIGS. 1–3, the capping machine in accordance with the present invention includes a machine base generally designated by reference numeral 10 which includes the usual drive and control mechanisms enclosed within a housing. A conveyor support assembly generally designated by reference numeral 12 is supported on a support table 11 attached to the top of the machine base 10. A conveyor 13 (FIG. 2), for example, an endless conveyor of conventional construction, is adapted to move on the conveyor support assembly 12. The machine also includes a control panel generally designated by reference numeral 14 (FIGS. 1 and 2) with operating elements such as push buttons and knobs and indicating devices such as lights. Vertical support rods 15 and 15′ are fastened at the conveyor support assembly 12. Horizontal support rods 16 and 16′ in turn are supported on the vertial rods 15, 15′, possibly adjustable in height for different size containers. Clamping bars 17 and 17′ which contain the gripping pads 18 are slidably mounted on the horizontal bars 16 and 16′ to enable reciprocatory movement for selectively holding a container or containers against rotation when the clamping bars 17 and 17′ are moved toward each other. The clamping bars 17 and 17′ together with the container gripping pads 18 are thereby actuated by conventional means not shown herein.

A frame structure generally designated by reference numeral 20 which includes support columns 21 support not only the cap reservoir 26 together with the vibratory feeder 25 and the chute 27 attached to the reservoir 26 but also the head frame assembly as will be discussed more fully by reference to FIGS. 4 through 6. A height-adjusting device 22, which may be provided, is schematically indicated in FIG. 3.

Figure 5:
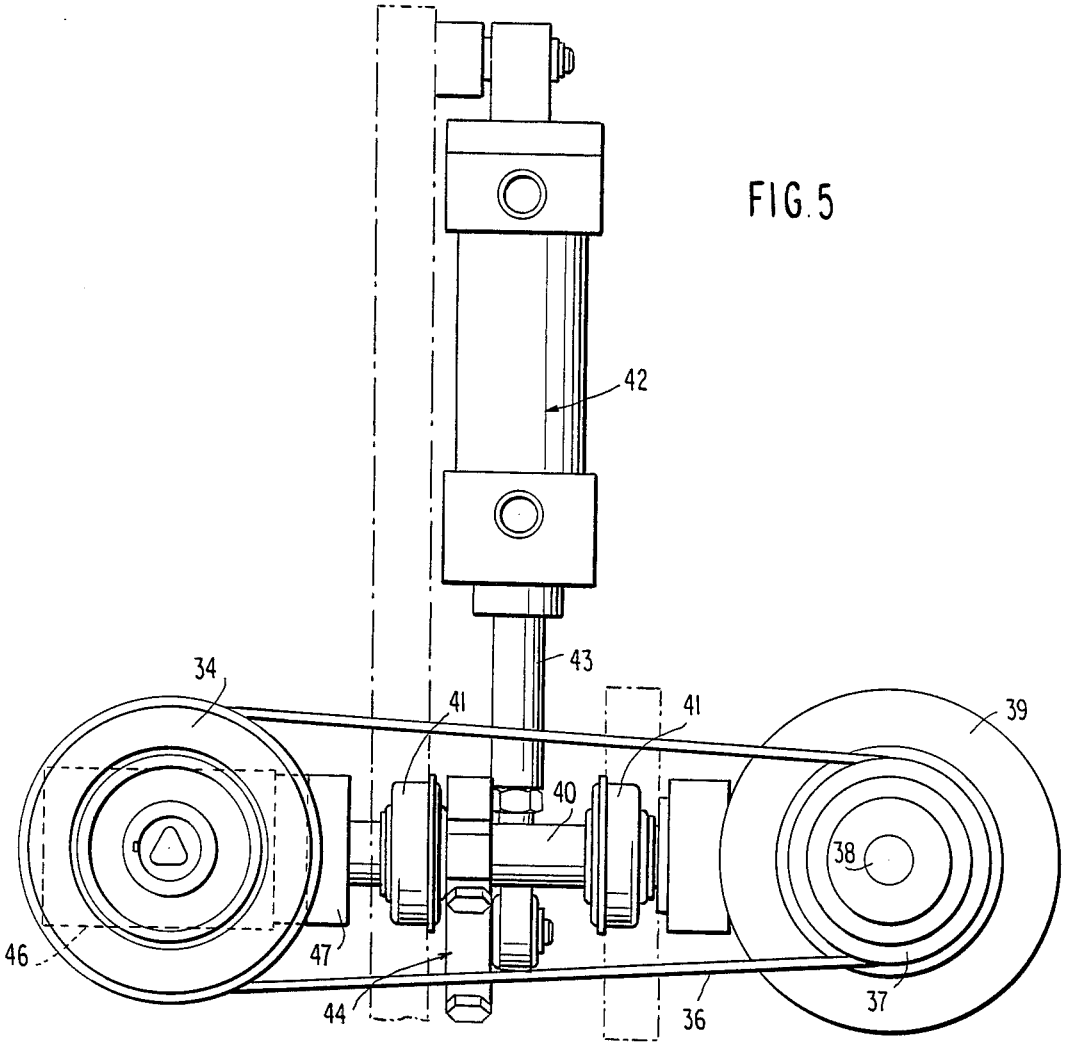
FIG. 5 is a top plan view on the head frame assembly of FIG. 1.
Figure 6:
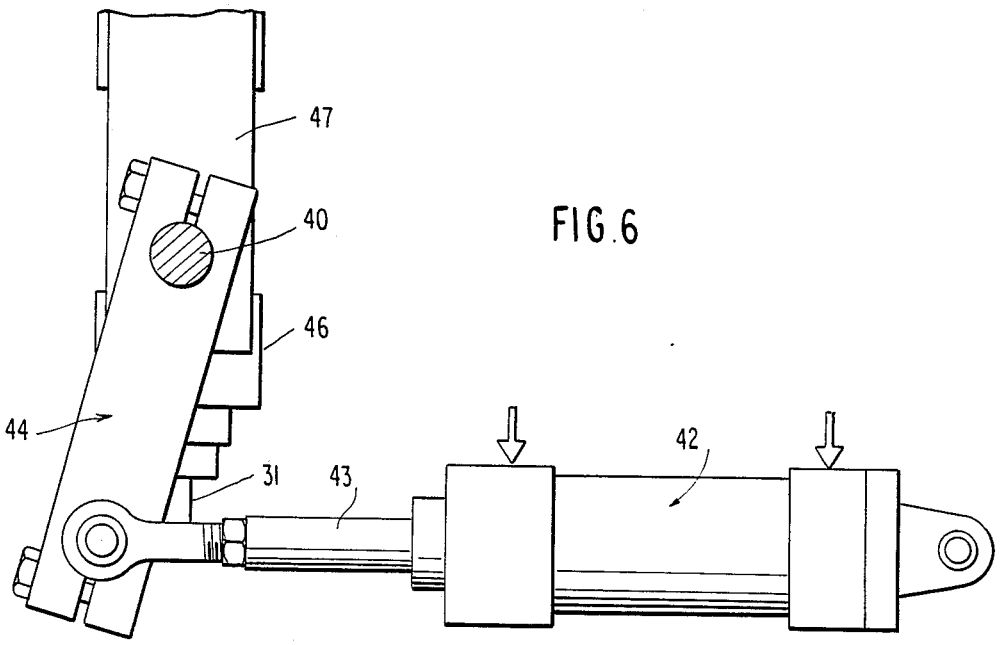
FIG. 6 is a side elevational view of the head frame assembly of FIGS. 4 and 5.

The head frame assembly in accordance with the present invention illustrated in FIGS. 4–6 includes a spindle assembly generally designated by reference numeral 30 which includes a rotatably supported spindle 31 whose lower end is adapted to be connected with a chuck 32 (FIG. 7) whose spring-loaded split rings 32′ are adapted to retain a cap 70. Additionally, the chuck 32 includes a rubber-like disk 32″ at the top of the cap 70 which applies the tightening torque to the cap 70 as the chuck 32 is displaced in the direction toward the open end of the container for capping the latter. A toothed driving pulley 34 is connected with the spindle 31 by way of a clutch assembly 35 of any conventional construction which is preferably a manually adjustable friction disk clutch to permit accurate adjustment of the torque with which the cap is fastened. The driving pulley 34 is driven by a motor 39, preferably an electric motor, whose motor shaft 38 carries a toothed pulley 37 that is in positive drive connection with the toothed pulley 34 by means of a toothed belt 36. The entire head frame assembly is enclosed within a housing 33 (FIGS. 1–3) which, because of the compactness of the head frame assembly in accordance with the present invention, can be accommodated within the space of about only one cubic foot.

The head frame assembly further includes a pivot shaft 40 which is pivotally supported relative to the machine frame (support column 21) by way of two ball bearing assemblies 41. A double-acting pneumatic cylinder generally designated by reference numeral 42 (FIGS. 5 and 6) is used to pivot the head frame assembly about the pivot axis of the shaft 40. To that end, the piston rod 43 is connected at one end with a piston (not shown) adapted to reciprocate within the pneumatic cylinder 42 depending on the admission of pressurized air at one or the other of the two ends of the pneumatic cylinder 42, schematically indicated by arrows (FIG. 6). The piston rod 43 is pivotally connected at its other end with a lever assembly 44 which in turn is non-rotatably connected with the pivot shaft 40. The actuating elements for pivoting the shaft 40 are thus all supported by the shaft 40. Additionally, the motor 39 is non-rotatably supported on the shaft 40 by means of the motor bracket 45.

A double-acting pneumatic cylinder 46 constitutes the actuating mechanism for movement of the spindle assembly 30 in its axial direction depending on the selected application of pressurized air at one or the other end of the pneumatic cylinder, schematically indicated again by arrows. To that end, a piston (not shown) which is adapted to reciprocate within the pneumatic cylinder 46 is fixedly connected with the spindle 31 so as to move in unison therewith. As a result thereof, displacement of the piston within the pneumatic cylinder 46 causes movement of the spindle 31 and therewith of the chuck 32 toward and away from the container held on the conveyor in the capping position. The pivot for the eccentric capping lever assembly 44 is designated in FIG. 4 by reference numeral 48. The end of the pneumatic cylinder 42 opposite the piston rod 43 is pivotally mounted to permit pivoting movement of the shaft 40. A plunger 50 (FIG. 1) of any conventional construction is operable to transfer the cap 70 at the end of the chute 20 to the pick-up means constituted by the chuck 32 as will be described more fully hereinafter by reference to FIGS. 8*a*, 8*b*.

For the sake of simplicity, only those parts necessary for an understanding of the operation of the present invention have been described herein, the remaining parts being of any known construction. For example, the control of the double-acting cylinders 42 and 46 as well as of the plunger 50 may be by conventional means such as solenoid valves, controlled by conventional electrical and/or electronic circuits provided for assuring the cyclic control to be described hereinafter. Since such control circuits are known as such in the art, a detailed description thereof is dispensed with herein.

OPERATION

The operation will be described by reference to FIGS. 8*a*–8*d*.

Figure 8A:
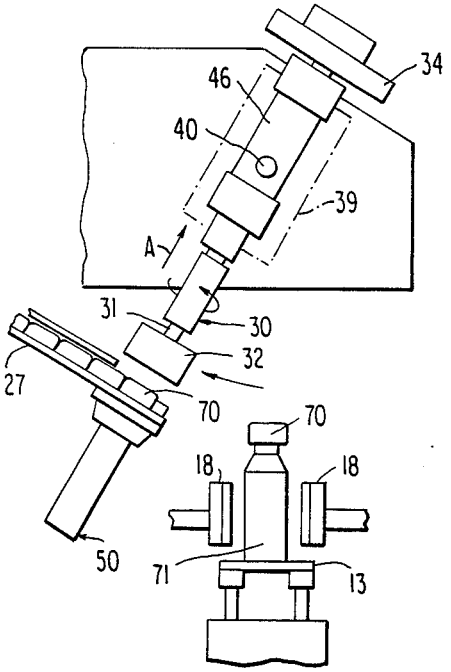
FIGS. 8*a*–8*d* are schematic views, illustrating the operation of the machine in accordance with the present invention.

In FIG. 8*a*, the capping operation of the container 71 has just been completed with the cap 70 securely fastened thereon and with the container gripping pads 18 moved away from the container 71 to permit the latter to leave the capping station. Additionally, by actuating the double-acting cylinder 42, the spindle assembly 30 together with the chuck 32 mounted on the spindle 31 and the double-acting pneumatic cylinder 46 have been pivoted from the capping position to the pick-up position. The rotating chuck 32 had also been retracted, i.e., moved in the direction of arrow A (FIG. 8*a*) by application of pressurized air to the lower compartment of the pneumatic cylinder 46. As the capped container 71 leaves the capping station, an indexing device of any known construction, for example, an escapement device in the form of an air cylinder allows the next container to enter the capping station. In FIG. 8*a*, the axis of the spindle assembly 30 is aligned with the axis of the plunger 50 which may be a spring-loaded pneumatic plunger or a double-acting pneumatic plunger of any known construction.

Next in the capping cycle, the gripper pads 18 have been closed again on the next container 71 to prevent the latter from rotation during the capping operation. Substantially simultaneously therewith, the plunger 50 is actuated to push the cap 70 in the chute end into the chuck 32. The cap 70 is held in the chuck 32 by the spring-loaded annular retaining device 32' (FIG. 7) while the plunger body holds back the line of caps in the chute 27 until the plunger 50 is again retracted (FIG. 8*b*).

Figure 8B:
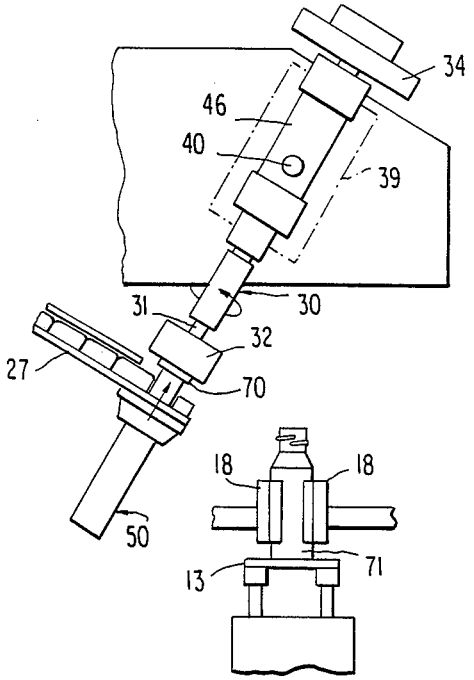
Figure 8C:
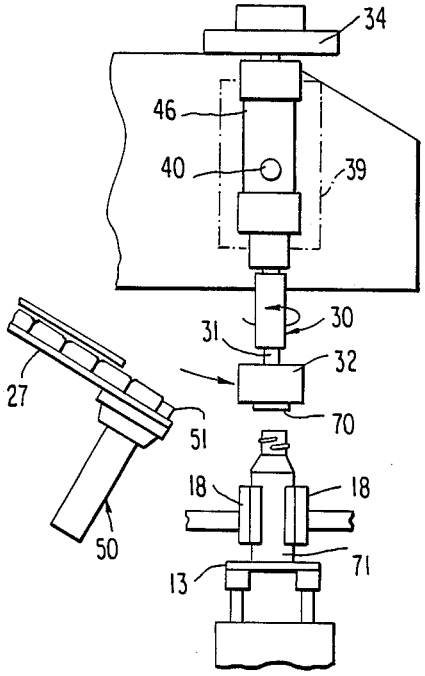
Figure 8D:
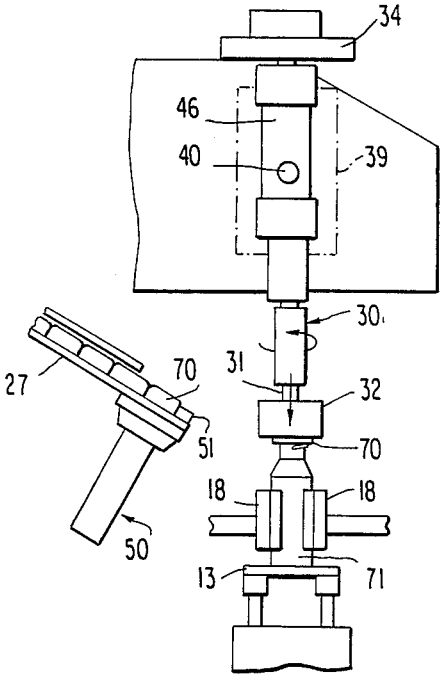

Next, the chuck 32 together with the spindle assembly 30 and the double-acting cylinder 46 is pivoted back into perfect vertical alignment with the container 70 as the plunger 50 is retracted to allow the line of caps in the chute 27 to move forward one cap diameter, with the first cap in line resting against a dead stop 51 (FIG. 8*c*).

Finally, the rotating chuck 32 together with the spindle assembly 30 is displaced into the extended position by admission of pressurized air into the upper compartment of the pneumatic cylinder 46, thereby moving the cap 70 onto the container neck. As the spindle assembly 30 is rotating owing to its positive drive connection with the motor 39, the chuck 32 screws the cap 70 onto the container 71 to the required torque as adjusted in the clutch assembly 35. Upon completion of the capping operation, the spindle assembly 30 together with the chuck 32 is retracted by admission of compressed air into the lower compartment of the double-acting pneumatic cylinder 46, and the cycle is thereafter repeated for the next cap and container.

The motor 39 may be operating continuously during the entire cycle or, if so desired, can be stopped by conventional control means while the head frame assembly parts are in the position illustrated in FIGS. 8*a* and 8*b*.

As can be seen from FIGS. 8*a* through 8*d*, the entire head frame assembly is pivoted during pivot movement of the spindle assembly 30. This means that the positive drive connection between the motor 39 and the spindle assembly 30 remains effective during an entire cycle of operation of the machine, regardless of whether the motor is energized continuously or is de-energized temporarily in the position of the parts illustrated in FIGS. 8*a* and 8*b*. FIGS. 8*a* through 8*d* also indicate the pivoting position of the motor 39 shown in dash and dotted lines in these figures.

According to another important feature of the present invention, the various pivoting components of the head frame assembly including the motor 39, the pulley 37 mounted on the motor shaft 38, the spindle assembly 30 together with the chuck 32 and the pneumatic cylinder 46 as well as the support brackets 45 and 47 are arranged in a counter-balanced array around the pivot axis of the shaft 40 so that only a small force is required to accomplish the rocking action. Furthermore, the axial movement of the spindle is effected by means of the built-in air cylinder 46 which eliminates the need for vertical oscillations of the entire head assembly during each cycle.

A significant advantage of the machine of this invention over the commercially available machines resides in the elimination of the cap transfer arm which allows use of a fixed chute end as opposed to a hinged chute end that must be used in conjunction with a cap transfer arm in order to prevent the cap pick-up bottom on the transfer arm from smashing into the chute end after returning to its position behind the chute end. In the prior art commercial machines, this is prevented by the use of such a hinged chute end which is mechanically lifted up to allow the transfer arm to return to its pick-up position.

Figure 9:
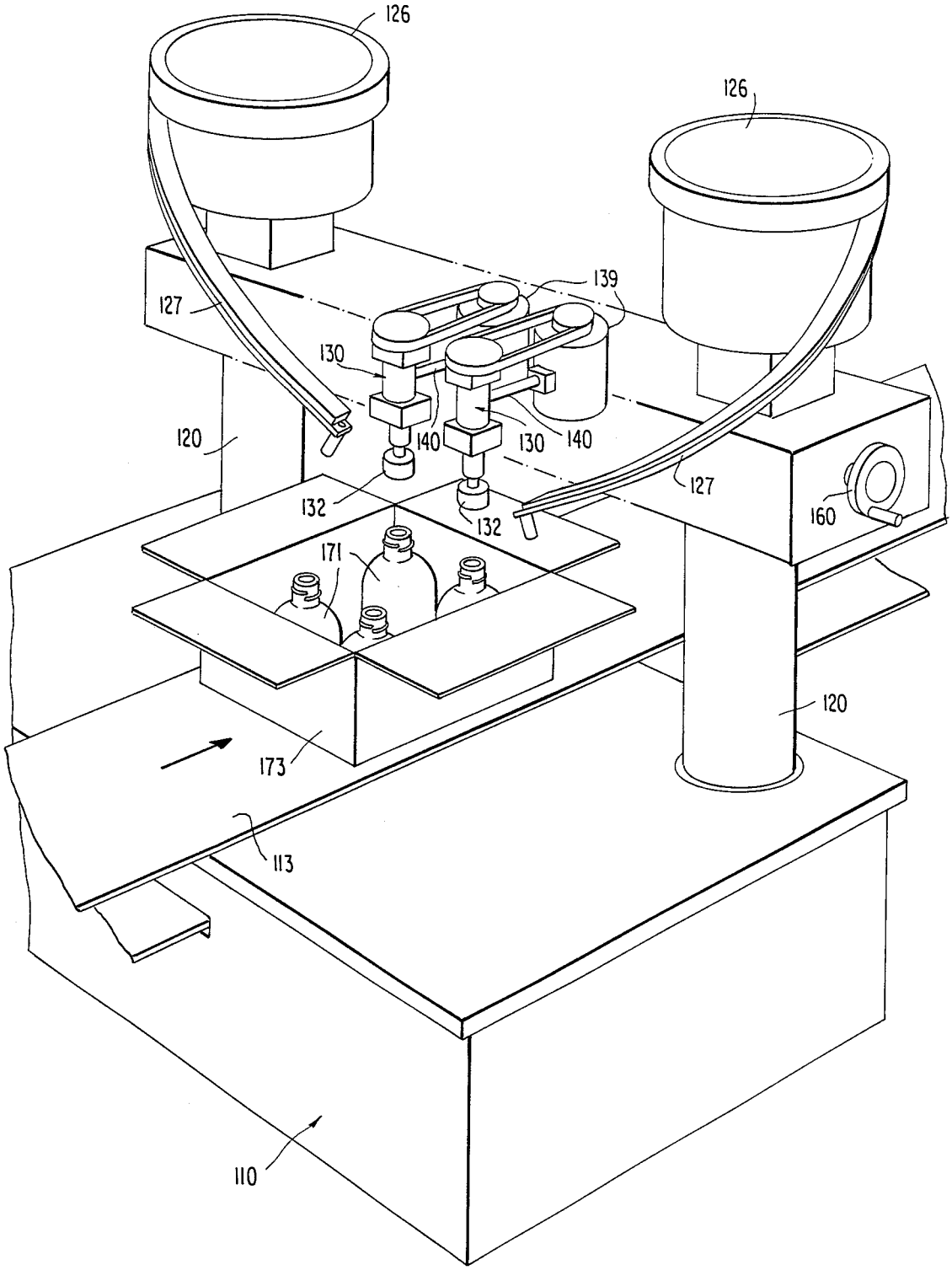
FIG. 9 is a schematic perspective view illustrating an in-case capper machine in accordance with the present invention.

The compact design of the head frame assembly also permits use thereof in a multi-spindle machine schematically illustrated in FIG. 9 in which similar parts are designated by corresponding reference numerals of the 100 series. As can be seen, there are four containers 171, two arranged side-by-side and two one behind the other within the case 173. Of course, larger size cases can also be used. Additionally, the multi-spindle machine of FIG. 9 includes a hand-wheel adjusting mechanism generally designated by reference numeral 160 to accurately adjust the center spacing of the chucks 132. The feeder cap reservoirs 126 thereby move in fixed relation to chucks 130, the motors 139 and the fixed pulley drives connecting the same.

While I have shown and described only two embodiments in accordance with the present invention, it is understood that the same is not limited thereto but is susceptible of numerous changes and modifications as known to those skilled in the art. Thus, for example, the cap feeder system, the conveying mechanism, the cap retention device in the chuck, the torque-adjusting clutch, etc. may all be modified as known to those skilled in the art. For example, the container conveyance may become superfluous if an escapement device is used or an indexing turret or a lug chain or an intermittent screw feed, as known in the art. The significant feature of the present invention which could be used in all such modified systems resides in the pivoting head frame assembly as disclosed and described hereinabove. Consequently, I do not wish to be limited to the details shown and described herein, but intend to cover all such changes and modifications as are encompassed by the scope of the appended claims.

I claim:

1. A capping machine with a relatively fixed frame part, in which open containers are successively brought to a capping station where a respective container is held against rotation to permit closing of the open container end by rotary movement of a cap fed from a reservoir means to a pick-up station laterally spaced from the open end of the container, comprising means in said machine for picking up a cap at said pick-up station, moving said cap over the open end of the container held in the capping station and fastening said cap onto the open end of the container by rotary movement causing engagement of complementary means provided at the open end of the container and at the cap including pick-up means operable in a pick-up position to pick-up a cap at the pick-up station, support means for supporting said pick-up means to enable rotary movement about its longitudinal axis as well as longitudinal movement in the direction of its axis, drive means drivingly connected to said pick-up means for rotating the latter, and means pivotally supporting said pick-up means, said support means and said drive means as a unit in said relatively fixed frame part about a pivot axis to pivot said pick-up means together with said drive means between the pick-up position and a capping position in which the cap held by said pick-up means is in alignment with the open end of the container.

2. A capping machine according to claim 1, wherein said drive means includes a motor drivingly connected with said pick-up means throughout the pivotal movement of the latter.

3. A capping machine according to claim 2, wherein said motor is an electric motor positively connected with said pick-up means.

4. A capping machine according to claim 3, further comprising control means for de-energizing the motor when said pick-up means is in the pick-up position.

5. A capping machine according to claim 1, wherein said complementary means include external and internal threads provided on a neck of the container and on the cap.

6. A capping machine according to claim 1, wherein the assembly including the pick-up means, the support means, and the drive means is at least nearly balanced about said pivot axis.

7. A capping machine according to claim 1, wherein said pick-up means includes a capping spindle, a chuck means at its end nearer the container and a spindle drive member near the other end and operatively connected with said spindle by way of a clutch means, said drive means including a motor having a motor spindle and a positive drive connection between said motor spindle and said spindle drive member, said spindle being rotatable in said support means, and wherein all parts rotatable about said pivot axis including the pick-up means and the drive means are at least nearly balanced about said pivot axis.

8. A capping machine according to claim 7, wherein said clutch means is an adjustable friction clutch to enable accurate adjustment of the torque with which a cap is fastened.

9. A capping machine according to claim 7, wherein the driving member includes a toothed pulley, and wherein said positive drive connection includes a toothed belt drivingly connecting said toothed pulley with another toothed pulley non-rotatably connected with the motor shaft.

10. A capping machine according to claim 1, wherein the machine is an in-case capper for simultaneously capping several open containers within a single case, the machine having a number of cooperating pick-up means, support means, drive means and pivot means corresponding to the number of containers in the case which are capped in the same cycle of operation.

11. A capping machine according to claim 10, wherein the machine is capable of capping simultaneously at least four containers, with at least two containers disposed side-by-side in the case and at least two containers disposed one behind the other.

12. A capping machine for capping open containers brought successively to a capping station, where a respective container is held stationary against rotation to permit closing of the open container by rotary movement of a cap fed from a cap reservoir to a pick-up station by way of a chute, and thereafter transferred over the open container, comprising rotatable pick-up means, drive means for said pick-up means to rotate the latter, first means for moving said drive means together with said pick-up means from a first position in which said pick-up means is in substantial alignment with the open end of the container into a second position in which the pick-up means is in substantial alignment with the next cap fed from the reservoir, second means for transferring the cap in the pick-up station to said pick-up means which retains the cap, third means for moving said drive means together with said pick-up means from said second position back to said first position, and fourth means for applying the cap retained by said pick-up means to the open end of the container by rotary movement imparted to said pick-up means by said drive means.

13. A capping machine according to claim 12, wherein said first and third means are operable to cause the drive means together with the pick-up means to rock back and forth between the two positions while the third means includes a plunger means for displacing the cap toward the pick-up means and the fourth means includes further means for moving the pick-up means at first toward the open container end and after completion of the capping operation away from the capped container.

14. A capping machine according to claim 13, wherein the plunger means is pneumatically actuated, wherein said first and third means include a common double-acting pneumatically operated actuator, and wherein said fourth means also includes a double-acting pneumatically operated actuator.

15. A capping machine according to claim 12, wherein said pick-up means and drive means are pivotal about a pivot axis, wherein said pick-up means includes a capping spindle, a chuck means at its end nearer the container and a spindle drive member near the other end and operatively connected with said spindle by way of a clutch means, said drive means including a motor having a motor spindle and a positive drive connection between said motor spindle and said spindle drive member, said spindle being rotatable, and wherein all parts rotatable about said pivot axis including the pick-up means and the drive means are at least nearly balanced about said pivot axis.

16. A capping machine according to claim 15, wherein said clutch means is an adjustable friction clutch to enable accurate adjustment of the torque with which a cap is fastened.

17. A capping machine according to claim 15, wherein the driving member includes a toothed pulley, and wherein said positive drive connection includes a toothed belt drivingly connecting said toothed pulley with another toothed pulley non-rotatably connected with the motor shaft.

18. A capping machine for capping open containers brought successively to a capping station, where a respective container is held stationary against rotation to permit closing of the open container by rotary movement of a cap fed from a cap reservoir to a pick-up station by way of a chute, and thereafter transferred over the open container, comprising rotatable pick-up means, drive means for said pick-up means to rotate the latter, first means for moving said drive means together with said pick-up means by pivoting movement about a pivot axis from a first position in which said pick-up means is in substantial alignment with the open end of the container into a second position in which the pick-up means is in substantial alignment with the next cap fed from the reservoir, second means for transferring the cap in the pick-up station to said pick-up means which retains the cap, third means for moving said drive means together with said pick-up means by pivoting movement about said pivot axis from said second position back to said first position, and fourth means for applying the cap retained by said pick-up means to the open end of the container by rotary movement imparted to said pick-up means by said drive means.

19. A capping machine according to claim 18, wherein the machine is an in-case capper for simultaneously capping several open containers within a single case, the machine having a number of cooperating pick-up means, drive means and pivot means corresponding to the number of containers in the case which are capped at the same time.

20. A capping machine according to claim 19, wherein the machine is capable of capping simultaneously at least four containers, with at least two containers disposed side-by-side in the case and at least two containers disposed one behind the other.

* * * * *